US006070745A

United States Patent [19]

Dembicks

[11] Patent Number: 6,070,745

[45] Date of Patent: Jun. 6, 2000

[54] COMPACT TOOL HOLDER AND DISPLAY SYSTEM

[76] Inventor: Andrew E. Dembicks, 5308 Boca Marina Cir. North, Boca Raton, Fla. 33487

[21] Appl. No.: 09/009,979

[22] Filed: Jan. 21, 1998

[51] Int. Cl.[7] ..... A47F 7/00

[52] U.S. Cl. ..... 211/70.6; 206/378; 211/89.01; 211/94.01

[58] Field of Search ..... 211/70.6, 89.01, 211/94.01; 206/378, 493

[56] References Cited

U.S. PATENT DOCUMENTS 4,927,020 5/1990 Randy ..... 206/378
4,987,998 1/1991 Tsai ..... 211/70.6 X
5,467,874 11/1995 Whitaker ..... 211/70.6
5,501,342 3/1996 Geibel ..... 211/70.6

*Primary Examiner*—Daniel P. Stodola
*Attorney, Agent, or Firm*—Quarles & Brady LLP

[57] ABSTRACT

A holder system for interchangeable socket members comprises at least one socket receiving member, a base, and a lock member. The socket receiving member has a central axis and nub for engaging a socket. The socket receiving member is also removably attached to the base. The lock member has a lock stop, and the lock member is removably insertable into the receiving member. The lock member also prevents the nub from releasing the socket receiving member. The base and the lock stop prevent movement of the lock member in either direction along the central axis.

9 Claims, 3 Drawing Sheets

COMPACT TOOL HOLDER AND DISPLAY SYSTEM

FIELD OF THE INVENTION

The present invention relates to the secure storage of interchangeable socket members for types of tools such as ratchet wrenches, having integral shafts or shaft receiving members. More particularly, this invention relates to a new and improved holder system which can either hold interchangeable sockets in a non-removable fashion or hold interchangeable sockets in a removable fashion.

BACKGROUND OF THE INVENTION

Ratchet wrenches of the kind which are used by professional and amateur mechanics commonly include a gripping handle integrally formed with a ratchet head unit. The ratchet head unit generally includes a male sexed ratchet drive nub operationally connected to a reversible ratchet mechanism positioned within the ratchet head. Detachable interchangeable sockets, also known as sockets, are available for use with such ratchets which include a drive aperture dimensioned to receive male sexed ratchet drive nubs of certain standard sizes. For example, standard sized drive nubs may be ¼, ⅜ or ½ inches square. On an opposite end of the socket there is typically provided a second aperture designed to securely engage a nut or the head of a bolt.

It is often desirable to store a series of sockets for ratchet wrenches in an organized manner so that various socket sizes for use with different size nuts and bolts may be easily located. Systems of the prior art for storing such sockets have included elongated metal rack systems with resilient male-engaging members for engaging the drive end of a socket to be stored thereon. These elongated rack systems mainly serve two functions. The rack system's first function is to display the set of sockets. The second function of the rack system is to store the set of sockets.

The first function of the rack system involves the display of a set of sockets within a store or in a similar setting in which a potential buyer will be able to view the socket members. In this setting, a problem exists because the potential for theft of these sockets is high. Theft of the sockets is possible because conventional rack system holds the sockets with such a force as to allow the sockets to be easily removed from the rack system. During display, the sockets would ideally be held by the rack system with such force that the sockets would be inseparable from the rack system. However, current rack systems do not hold sockets with such force because these rack systems are primarily designed to fulfill the requirements of the second function of the rack system as recited above.

The second function of the rack system is to store the sockets once the socket set has been acquired and placed in use. This necessitates easy removal of the sockets from the rack system when a particular socket is to be used. Allowing the sockets to be easily removed from the rack requires that the rack hold the socket with as little force as possible while still holding the socket with sufficient force so that the socket will not become detached if the rack is dropped or handled roughly.

Thus, a problem exists because a rack system has two competing requirements: first, the rack system should be able to hold the sockets with minimal force so as to be easily removed by the user, and second, the rack system should be able to lock the sockets so as prevent removal of the sockets by a potential thief, or as a result of mishandling.

SUMMARY OF THE INVENTION

It is an object of this invention to provide a holder system for interchangeable sockets which allows them to be easily reattached to and detached from a rack when the holder system is in the possession of a user of the interchangeable sockets.

It is another object of this invention to provide a holder system for interchangeable sockets which prevents the interchangeable sockets from being removed from a rack when the holder system is being used to display the interchangeable sockets for sale.

In accordance with the invention, these and other objects are accomplished by providing a holder system comprising a socket receiving member, a lock member, and a base. The socket receiving member is comprised of a foundation section and a box member. The foundation section is formed transverse to a central axis of the socket receiving member, and the box member extends from an upper surface of the foundation section. The box member also has a pair of opposing resilient retaining walls and a pair of opposing guide walls transverse to the retaining walls. Additionally, an outwardly facing nub is disposed on an outward-facing surface of at least one of the retaining walls so as to engage a shaft receiving member of a socket.

The lock member is inserted within the cavity defined by the guide and retaining walls, and the lock member is comprised of: a lock body; one pair of opposing braces extending from the lock body, and a lock stop. The pair of opposing braces are disposed between the pair of opposing retaining walls to prevent the nub on the retaining wall from being urged towards the central axis.

The base is comprised of opposing base side walls formed on an elongated base member. The foundation section is positioned within the base and between the pair of opposing base side walls. Also, the base member and the lock stop prevents movement of the lock member relative to the socket receiving member in either direction along the axis.

BRIEF DESCRIPTION OF THE DRAWINGS

Presently preferred embodiments of the inventive arrangements are shown in the drawings, it being understood, however, the inventive arrangements are not limited to the precise arrangements and instrumentalities shown.

DETAILED DESCRIPTION OF THE PREFERRED EMBODIMENTS

Figure 1:
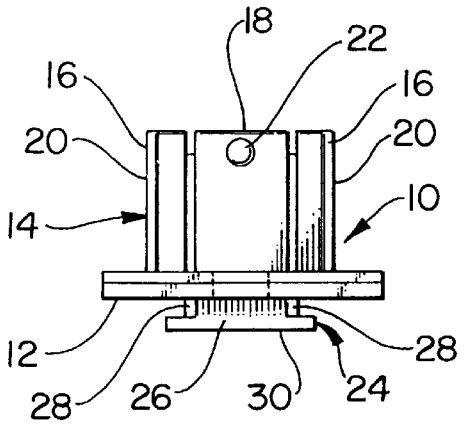
FIG. 1 is a front view of a socket receiving member and a partial front view of a lock member.
Figure 2:
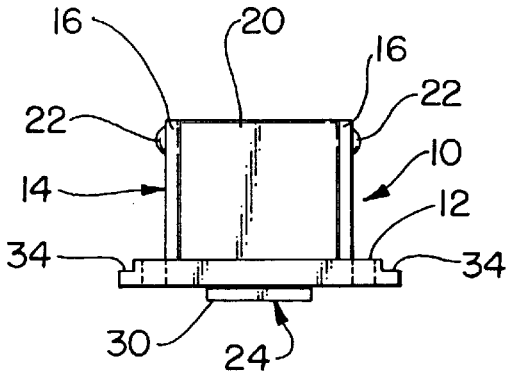
FIG. 2 is a side elevation view of the socket receiving member and a partial side elevation view of the lock member.
Figure 3:
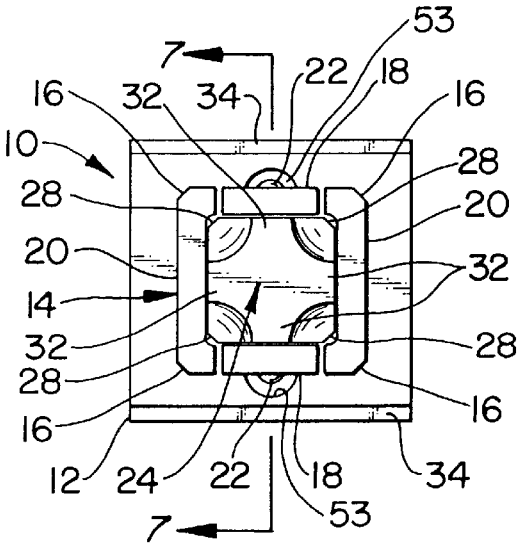
FIG. 3 is a top view of the socket receiving member and a partial top view of the lock member.

As shown in FIGS. 1–9 a socket holder system is disclosed which includes a socket receiving member 10, a lock member 24, and a base 36. The socket receiving member 10 includes a flattened or planar foundation section 12. A box member 14 is formed on an upper surface of the foundation section 12. The box member 14 is advantageously dimensioned to inter-fit with a standard drive aperture formed on a socket. Typically, the box member 14 will be dimensioned to snugly nest within a ¼", ⅜" or ½" square drive aperture formed on a socket for a wrench, as is well known in this industry.

At the each corner of the box member 14 is preferably formed a chamfer 16. Chamfers 16 at the corners of the box member 14 allows the box member 14 to slide easily into and to be removed easily from a socket drive aperture.

In a preferred embodiment, the box member 14 has a pair of opposing and resilient retaining walls 18. The box member 14 also has a pair of opposing base walls 20 which are perpendicular to the retaining walls 18. However, the invention is not limited in this regard. In another embodiment, not shown, a second pair of resilient retaining walls 18 may be substituted for opposing base walls 20 so that a total of two pairs of resilient training walls are provided. This additional pair of retaining walls 18 would negate the need for the pair of base walls 20. However, to add rigidness to the box member 14, four base posts may be placed at the four intersections of the four retaining walls 18.

On at least one of the retaining walls 18 is disposed an outwardly facing nub 22. The nub 22 is sized and positioned to be received by a recess in the square drive aperture, as is well known in this industry. The nub 22 is prevented from being urged towards a central axis of the socket receiving member 10 because of the lock member 24. A nub 22 is disposed on each retaining wall 18 in the presently preferred embodiment. Clearance recess 53 may optionally be provided to facilitate efficient molding.

The lock member 24 has a lock body 26 and at least one pair of opposing braces 32 extending from the lock body 26. The lock member 24 is positioned within the cavity, and the first pair of braces 32 are positioned snugly between the retaining walls 18 so as to prevent the retaining walls 18 from being urged towards the central axis of the socket receiving member 10. In the presently preferred embodiment, a second pair of braces 32 are positioned snugly between the guide walls 20.

When only one pair of braces 32 are used, the lock member 24 can be disposed within the cavity in an unlocked position. An unlocked position would place the pair of braces 32 between the guide walls 20 instead of the retaining walls 18. Thus, the retaining wall 18 would not be prevented from being urged towards the central axis.

At the each corner of the lock body 26 is preferably formed a lock chamfer 28. Lock chamfers 28 at the corners of the lock body 26 allows the lock body 26 to slide easily in and out the cavity.

A lock stop 30 can be any means that prevents the lock member 24 from moving in an upward direction along the central axis towards a free end of the socket receiving member 10. The presently preferred lock stop 30 is a rim that extends from the bottom surface of the lock body 26 in a direction transverse to the central axis. The rim also protrudes from the cavity, and the rim is dimensioned so as to be prevented from passing through the cavity. However, the invention is not limited in this regard.

Instead of having the lock stop 30 protruding from cavity, the rim can be flush to the bottom surface of the foundation section 12, or alternatively, recessed within the foundation section 12. Both would require a recess within the bottom surface of the foundation section 12 dimensioned to accept the rim of the lock stop 30. However, the lock stop 30 still prevents the lock member 24 from moving in an upward direction along the central axis towards the free end of the socket receiving member 10.

Another example of an alternative lock stop 30 would have the lock body 26 tapering outwardly from the middle of the lock body 26 to the end of the lock body 26 adjacent to the bottom surface of the foundation section 12. Also, near the bottom surface of the foundation section 12, the cavity would flare outwardly so as to accept the outward taper of the lock body 26. Because the width of the lock body 26 at the end adjacent to the bottom surface of the foundation section 12 is wider than the cavity before the flare, the lock member 24 is prevented from moving in an upward direction along the central axis towards a free end of the box member 14. Such an alternative lock stop 30 need not protrude from the cavity, and instead, the alternative lock stop 30 can be flush to the bottom surface of the foundation section 12, or alternatively, recessed within the foundation section 12.

Because the base 36 is positioned below the lock stop 30, and because of the lock stop 30, the lock member 24 is prevented from moving in either direction along the central axis. Thus, the lock member 24 cannot be removed from the cavity when base 36 is in place. Significantly, this feature prevents a socket member already engaged by the socket receiving member 10 from being released or removed from the socket receiving member 10 when the base 36 is positioned below the lock stop 30. This feature will be discussed in more detail during the discussion of FIGS. 7 and 8.

Figure 5:
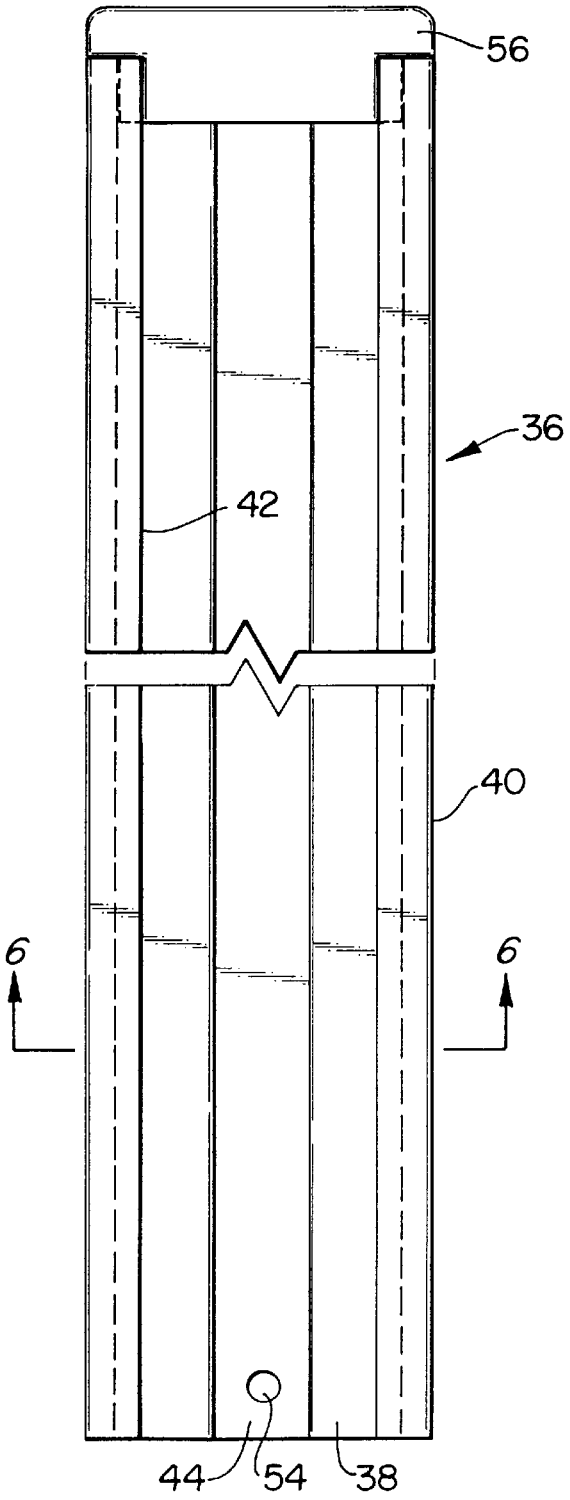
FIG. 5 is a top view of a base with the base side walls shown in phantom.
Figure 6:
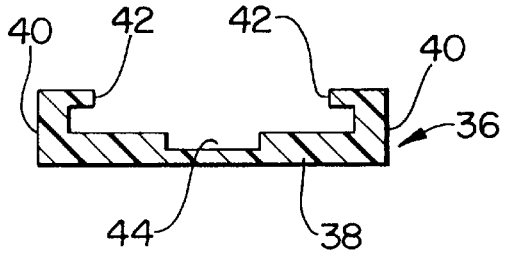
FIG. 6 is a sectional view of the base taken along line 6—6 in FIG. 5.
Figure 9:
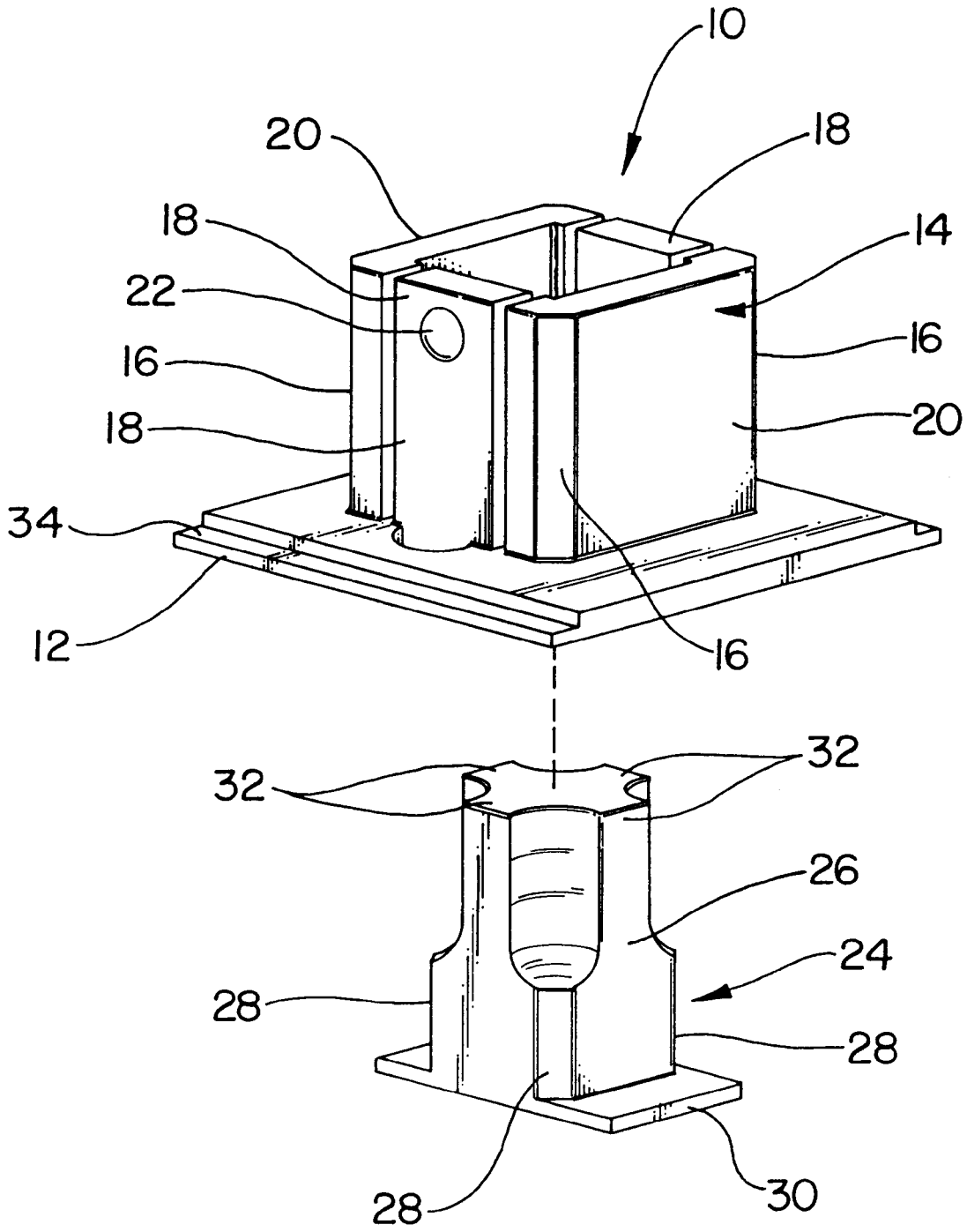
FIG. 9 is a exploded perspective view of the socket receiving member and lock member.

According to the invention, the foundation section 12 is positioned within base 36 as shown in FIGS. 7–10. As shown in FIGS. 5 and 6, the base 36 is comprised of an elongated base member 38, upon which are mounted opposing base side walls 40, which are parallel and spaced from one another along the length of base 36. At an upper edge of the base side walls 40, a base-retaining lip 42 is formed which projects inwardly from each of the base side walls 40 toward a center line defined along the length of the base 36. In a preferred embodiment, a detachable endcap 56 may be secured at opposing ends of base 36 to prevent socket receiving member 10 from sliding off the ends of base 36. The endcaps 56 may be secured in the base 36 by means of a detent engagement with a hole 54 provided on each end of the base as shown.

Figure 7:
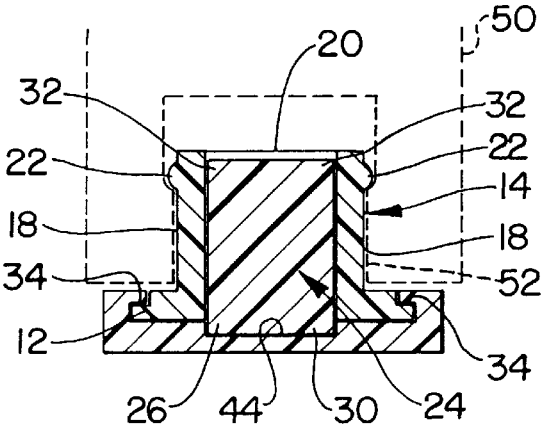
FIG. 7 is a sectional view of the socket receiving member and the lock member taken along line 7—7 in FIG. 3, shown positioned within the base in their locked or engaged position.
Figure 4:
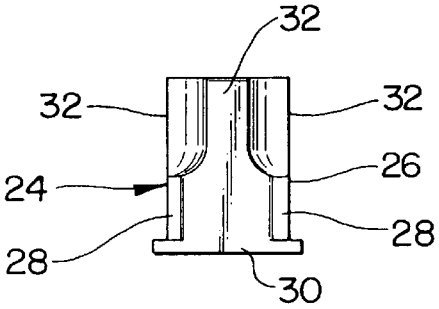
FIG. 4 is a front view of the lock member.
Figure 8:
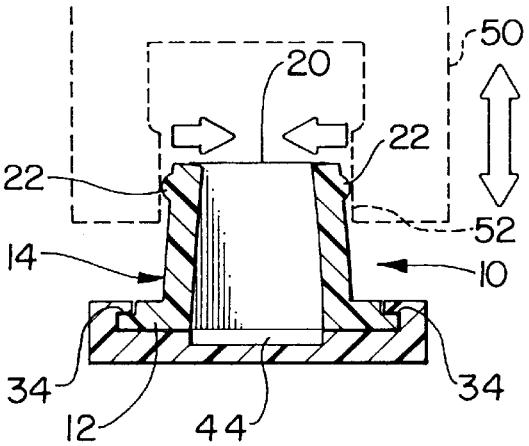
FIG. 8 is a sectional view of the socket receiving member without the lock member, shown positioned within the base in its unlocked or released position.

As shown in FIGS. 7 and 8, a shoulder 34 engages the base-retaining lip 42 when the foundation section 12 is positioned within the base 36. In this manner the foundation section 12 of the socket receiving member 10 may slide along the length of base 36, but is otherwise retained therein.

If the lock stop 30 protrudes from the cavity, a base slot 44 may or may not be used. A base slot 44 is a slot in the base member 38 parallel to the base side walls 40 and dimensioned to receive the lock stop 30. When the lock stop 30 protrudes from the cavity, and a base slot 44 is not used, only the bottom of the lock stop 30 and not the bottom surface of the foundation section 12 will rest on the base 36. If the lock stop 30 protrudes from the cavity and a base slot 44 is used, the bottom surface of the foundation section 12 will rest on the base 36. The bottom surface of the foundation section 12 resting on the base 36 provides a more stable base than having only the bottom of the lock stop 30 resting on the base 36.

FIGS. 7 and 8 illustrate how the holder system is used to prevent a socket 50 from being removed from the socket receiving member 10, or alternatively, show how the holder system allows the socket 50 to be removed from or placed on the socket receiving member 10. FIG. 7 shows the socket 50 being held by the socket receiving member 10 when the lock member 24 is within the cavity. Because the greatest distance between the surface of the nubs 22 is greater than the distance between the aperture walls 52 of the standard drive aperture, the nubs 22 cannot slide past the aperture walls 52. The distance between the nubs 22 cannot become smaller because the lock member 24 prevents the retaining walls 18, on which the nubs 22 are attached, from bending inward.

However, when the lock member 24 is removed from the cavity, as shown in FIG. 8, the retaining walls 18 are allowed to bend inward. Thus, as the retaining walls 18 bend inward, the distance between the nubs 22 becomes smaller. When the distance between the nubs 22 is at least equal to or smaller than the distance between the aperture walls 52, the socket 50 can be removed from or placed on the socket receiving member 10.

In a typical scenario where a socket set is first displayed in a store and then sold to a user of the socket set, the socket holder system would be used in the following manner. First, each socket 50 would be placed on a socket receiving member 10. The locks 24 would then be placed in the cavity of each socket receiving member 10 so as to prevent the sockets 50 from being removed from the socket receiving members 10. The final step, before the sockets are to be displayed, would be to position each socket receiving member 10 into a base 36. When the sockets 50 are held in such a manner, removing the sockets 50 from the socket receiving member 10 is a time-consuming, multi-step process which does not allow a socket 50 to be easily stolen (removed).

Once the socket set is purchased and is to be used, the following steps should be followed. First, each combination of socket 50, lock member 24 and socket receiving member 10 are removed from the base 36. The lock member 24 is then removed from the socket receiving member 10. Finally, each combination of socket 50 and socket receiving member 10 are re-positioned into the base 36. Once the lock member 24 is removed from the socket receiving member 10, the socket holder system allows each socket 50 within the socket set to be easily removed from and placed back onto the socket receiving members 10.

What is claimed is:

1. A holder system for holding at least one socket member, said system comprising:

a socket receiving member having at least one pair of opposing resilient retaining walls and defining a cavity;

a nub for interlocking engagement with a socket member, said nub disposed on an outer facing surface of one of said retaining walls and moveable between a socket member interlocking engaging position and a socket member releasing position, said nub being urged towards said cavity in said socket member releasing position;

a lock member removably insertable into said cavity and having a lock stop and a lock body, said lock body being a brace disposed between said at least one of said pair of opposing retaining walls to prevent said nub from being urged by said at least one socket member towards said cavity into said socket member releasing position when said lock body is disposed in said cavity; and, a base, said base and said lock stop in combination for preventing removal of said lock member from said cavity, said socket receiving member removably attached to said base.

2. A holder system according to claim 1, wherein said receiving member includes a box member including said at least one pair of opposing resilient retaining walls.

3. A holder system according to claim 2, wherein said box member further comprises one pair of opposing guide walls.

4. A holder system according to claim 2, wherein:

said receiving member further comprises a foundation section formed transverse to said receiving member; and, said base further comprises opposing base side walls formed on an elongated base member, said foundation section positioned within said base between said pair of opposing base side walls.

5. A holder system according to claim 4, wherein said opposing base side walls are formed parallel to one another and project upwardly from said elongated base member along a length thereof and an inwardly projecting retaining lip is defined on an upper edge of said opposing base side walls for retaining said socket receiving member between said opposing base side walls.

6. A holder system according to claim 1, wherein:

said lock stop is a rim extending from a distal end of said lock body in a direction transverse to said body;

said distal end protrudes adjacent said base from said cavity; and, said rim is dimensioned for preventing said rim from passing through said cavity.

7. A holder system according to claim 6, wherein said base defines a base slot extending along a longitudinal axis of said base, said base slot dimensioned to accept said rim.

8. A holder system for holding at least one interchangeable socket member, said system comprising:

at least one socket receiving member having resilient retaining walls bounding a cavity and moveable between socket member interlocking engaging and releasing positions;

a lock member having opposing braces removably insertable into said cavity, said opposing braces preventing movement of said retaining walls inwardly towards each other and out of said socket member interlocking engaging positions, said lock member having a lock stop; and, a base for slidably receiving said at least one socket receiving member together with a received socket and an inserted lock member, said lock stop and said base preventing removal of said inserted lock member.

9. A holder system for holding at least one interchangeable socket member, said system comprising:

(a) a socket receiving member comprised of a foundation section formed transverse to a central axis of said socket receiving member;

a box member extending from an upper surface of said foundation section and having a pair of opposing retaining walls, said retaining walls defining a cavity;

an outwardly facing nub disposed on at least one of said retaining walls so as to engage a socket;

(b) a lock member positioned within said cavity comprised of a lock body;

one pair of opposing braces extending from said lock body and disposed between said pair of opposing resilient retaining walls so as to prevent said nub on at least one of said retaining walls from being urged towards said central axis;

a lock stop extending from said lock body; and, (c) a base comprised of opposing base side walls formed on an elongated base member, said foundation section positioned within said base between said pair of opposing base side walls, and said base member and said lock stop preventing movement of said lock member relative to said socket receiving member in either direction along said cavity.

* * * * *